US005342168A

United States Patent [19]

Weigel et al.

[11] Patent Number: 5,342,168

[45] Date of Patent: Aug. 30, 1994

[54] ADJUSTABLE RADIAL-FLOW DIFFUSER

[75] Inventors: Albrecht Weigel, Germering; Uwe Schmidt-Eisenlohr, München, both of Fed. Rep. of Germany

[73] Assignee: MTU Motoren- Und Turbinen-Union GmbH, Fed. Rep. of Germany

[21] Appl. No.: 96,309

[22] Filed: Jul. 26, 1993

[30] Foreign Application Priority Data

Jul. 30, 1992 [DE] Fed. Rep. of Germany ..... 4225126

[51] Int. Cl.[5] ..... F01D 17/14

[52] U.S. Cl. ..... 415/148; 415/208.3

[58] Field of Search ..... 415/208.1, 208.2, 208.3, 415/211.1, 211.2, 212.1, 148, 150

[56] References Cited

U.S. PATENT DOCUMENTS

| | | | |
|---|---|---|---|
| 2,904,307 | 9/1957 | Balje | 415/143 |
| 2,985,427 | 3/1961 | Houghton | 415/148 |
| 3,069,070 | 12/1962 | Macaluso et al. | 415/148 |
| 3,326,522 | 6/1967 | Pickering | 415/148 |
| 3,963,369 | 6/1976 | Balje | 415/148 |
| 4,054,398 | 10/1977 | Penny | 415/208.3 |
| 4,325,673 | 4/1982 | Hall, Jr. | 415/208.3 |
| 4,338,063 | 7/1982 | Nakanishi | 415/208.3 |
| 4,770,605 | 9/1988 | Nakatomi | 415/148 |

FOREIGN PATENT DOCUMENTS

| | | | |
|---|---|---|---|
| 0134748 | 3/1985 | European Pat. Off. . | |
| 15797 | 1/1983 | Japan | 415/148 |
| 492130 | 7/1970 | Switzerland . | |

*Primary Examiner*—John T. Kwon

*Attorney, Agent, or Firm*—Evenson, McKeown, Edwards & Lenahan

[57] ABSTRACT

An adjustable radial flow diffuser for a radial flow compressor includes adjusting elements having diffuser blades. The adjusting elements are arranged in a diffuser annulus uniformly distributed along the diffuser circumference with an angular pitch δ. The adjusting elements further are swivellable about an adjusting axis V parallel to the longitudinal axis of the compressor for changing the narrow cross-section between the diffuser blades. The adjusting elements have either a substantially U-shaped or H-shaped cross-section with sector-shaped plates that are mounted on both sides of a blade root to form the legs. The diffuser blade forms the web of the substantially U or H shaped cross-section.

14 Claims, 8 Drawing Sheets

ADJUSTABLE RADIAL-FLOW DIFFUSER

BACKGROUND AND SUMMARY OF THE INVENTION

This invention relates to an adjustable radial-flow diffuser for a radial-flow compressor which includes adjusting elements with blades. The adjusting elements are arranged in a diffuser annulus and are uniformly distributed along the diffuser circumference with the angular pitch δ. For changing the narrow cross-section Q between the blades, the adjusting elements in each case are swivellable about an adjusting axis V which is parallel to the longitudinal axis L of the compressor.

It is an object of a radial-flow diffuser of this type to reduce the flow rate supplied to the gas flow via the compressor rotor and, as a result, to convert its kinematic energy into static pressure. Since at different rotational speeds compressors furnish a very different pressure build-up, the volume flow at the wheel outlet changes differently than at the wheel inlet. It is therefore necessary to adapt the diffusers to the different volume flows in order to achieve, under all operating conditions, an optimal efficiency of the energy conversion. In the case of a radial-flow compressor, the pressure throughput characteristic is a function of the adaptation of the diffuser capacity, which is determined by the narrow area of the diffuser, to the volume flow furnished by the rotor. These narrow diffuser areas are defined by the smallest area which is normal to the flow direction between two adjacent diffuser blades respectively. In the case of a low pressure ratio (in the case of a low rotational speed), the narrow areas of the diffuser are to be as large as possible and, when the pressure ratio is maximal, they should be correspondingly smaller. For this purpose, it is known to design the diffuser blades so that they can be adjusted in different manners in order to be able to vary the mentioned diffuser areas.

For this purpose, it is known to arrange blades on a swivellable rotary table, as disclosed, for example, in Swiss Patent Document CH-PS 492 130. A disadvantage with respect to the efficiency of the diffuser are the gaps between the blades and the areas of the walls outside the rotary plate through which leakage flows flow from the delivery side to the suction side.

An alternative measure for the adaptation of the narrow diffuser area is disclosed, for example, in the European Patent Document EP 134 748 B1. In this case, the narrow cross-section is varied by means of an adjustable diffuser wall. Here, the rigid blades are fitted through slots of the adjustable diffuser wall. However, the step which is formed in the annulus between the diffuser and the rotor causes efficiency-reducing turbulences of the flow. Also in this case, the area ratio which changes during the adjusting in the bladeless annulus between the rotor and the diffuser is a disadvantage.

Based on the above, there is therefore needed a radial-flow diffuser according to the above-mentioned type provided without any blade gap which largely avoids efficiency-reducing steps in the annulus.

According to the present invention, this need is met in that the adjusting elements have a U-shaped or an H-shaped cross-section, the sector-shaped plates mounted on both sides on the blade roots forming the legs and the diffuser blade forming the web.

The development according to the invention has the advantage that blade gaps are avoided between the blade delivery side and the blade suction side where there is a high pressure difference. Because of the slight pressure difference in the circumferential direction, a damaging flow on the rear side of the plates is insignificant. It is advantageous with respect to the efficiency for the blades to be able to be swivelled as a whole, whereby the area ratio and the length/width ratio of the diffuser ducts may be the optimal area. In particular, in the inlet area, the radial-flow diffuser is free of steps which are disposed transversely with respect to the main flow direction, whereby additional aerodynamic losses are eliminated.

In order to avoid losses as a result of incorrect positioning of the adjusting elements, the adjusting elements can preferably be swivelled synchronously and in the same direction by means of an adjusting mechanism.

For an aerodynamically favorably constructed radial-flow diffuser, it is important that transitions from the rotor to the diffuser annulus are constructed to be as continuous as possible along a large adjusting range of the adjusting elements.

A simple bearing of the adjusting element in the diffuser housing by way of bearing journals which are concentric with respect to the adjusting axes ensures an exact adjustability also in the case of thermal stress.

The clearance between the plate sides of adjacent adjusting elements which opens or closes during the adjusting movement and extends in the main flow direction is optimized in a fluidically advantageous manner. As a result, the dBe width of the clearance along the length of adjacent plate sides always remains constant. An aerodynamically unfavorable tilting of the clearance with respect to the flow direction may therefore be avoided along the whole adjusting area.

Another improved development of the invention is provided whereby the diffuser ducts of the throttled radial-flow diffuser, that is, in the case of the position of the adjusting elements which pertains to the smallest narrow cross-section, remain without clearances between the plates and without its influence on the flow. In the case of an unthrottled position of the adjusting elements, that is, in the case of a maximal size of the narrow cross-section, the plate outlet edges are disposed on a joint circle so that a continuous diffuser outlet is formed.

In the case of a further development of the invention, it is ensured that the adjusting elements within their adjusting range can be swivelled between the plates without the opening of a clearance. As a result, an improvement of the flow quality in the diffuser ducts can be achieved, particularly in the case of an unthrottled operation of the diffuser.

Other objects, advantages and novel features of the present invention will become apparent from the following detailed description of the invention when considered in conjunction with the accompanying drawings.

DETAILED DESCRIPTION OF THE DRAWINGS

Figure 1:
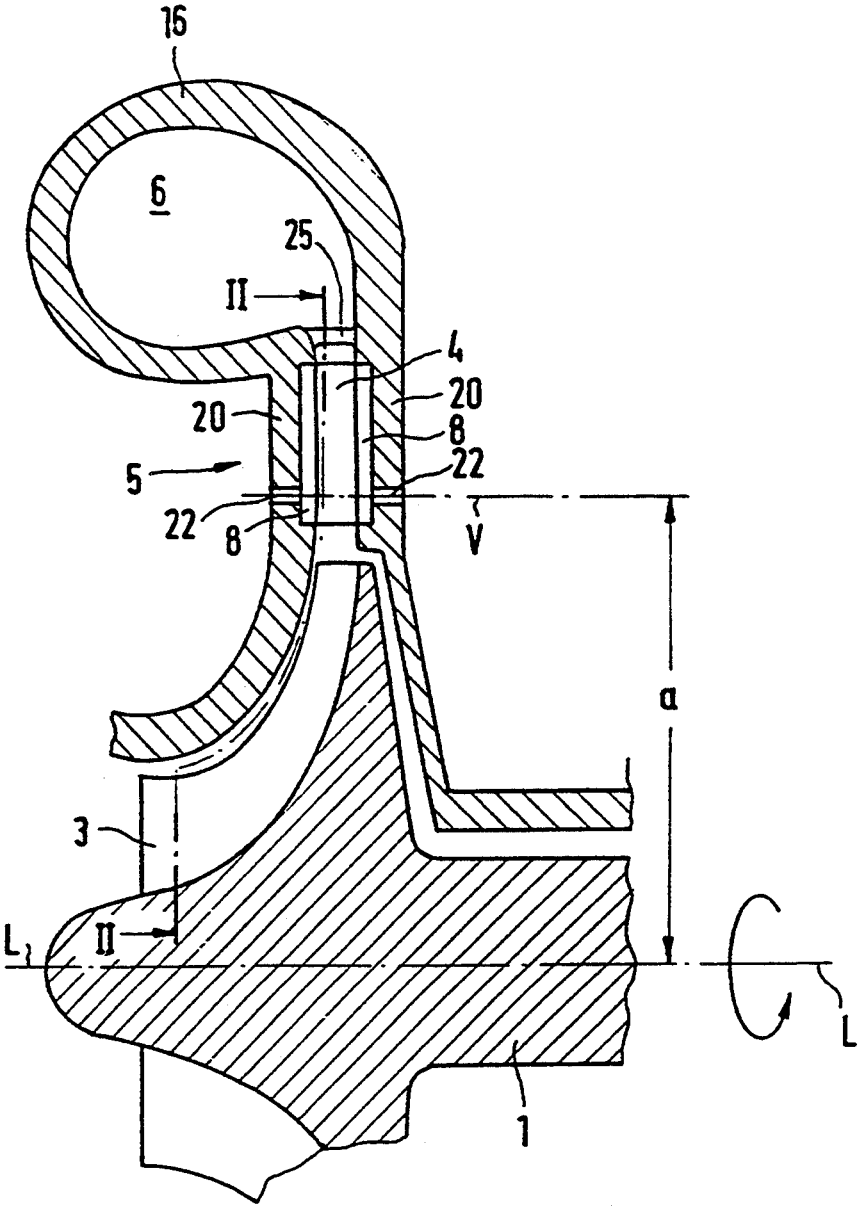
FIG. 1 is an axial sectional view of a radial-flow compressor with a radial-flow diffuser connected behind it.

An axial sectional view according to FIG. 1 illustrates a radial-flow compressor 1 which rotates about the longitudinal axis L of the compressor 1. By way of the radial-flow blades 3 distributed along the circumference of the radial compressor 1, the delivered gas flow is delivered into the area of the diffuser blades 4 of the radial-flow diffuser 5. Subsequently, the air is collected in the air collecting spiral 6 and is supplied to another compressor connected behind it or to a combustion chamber. Thus, by means of the radial-flow compressor 1, propulsion energy supplied from the outside is converted into potential and kinetic energy of the flow medium. In the radial-flow diffuser 5 equipped with the diffuser blades 4, the kinetic energy is then partially converted by deceleration into potential energy in the form of pressure. The mentioned deceleration is determined by the contour of the diffuser blades 4.

Figure 2:
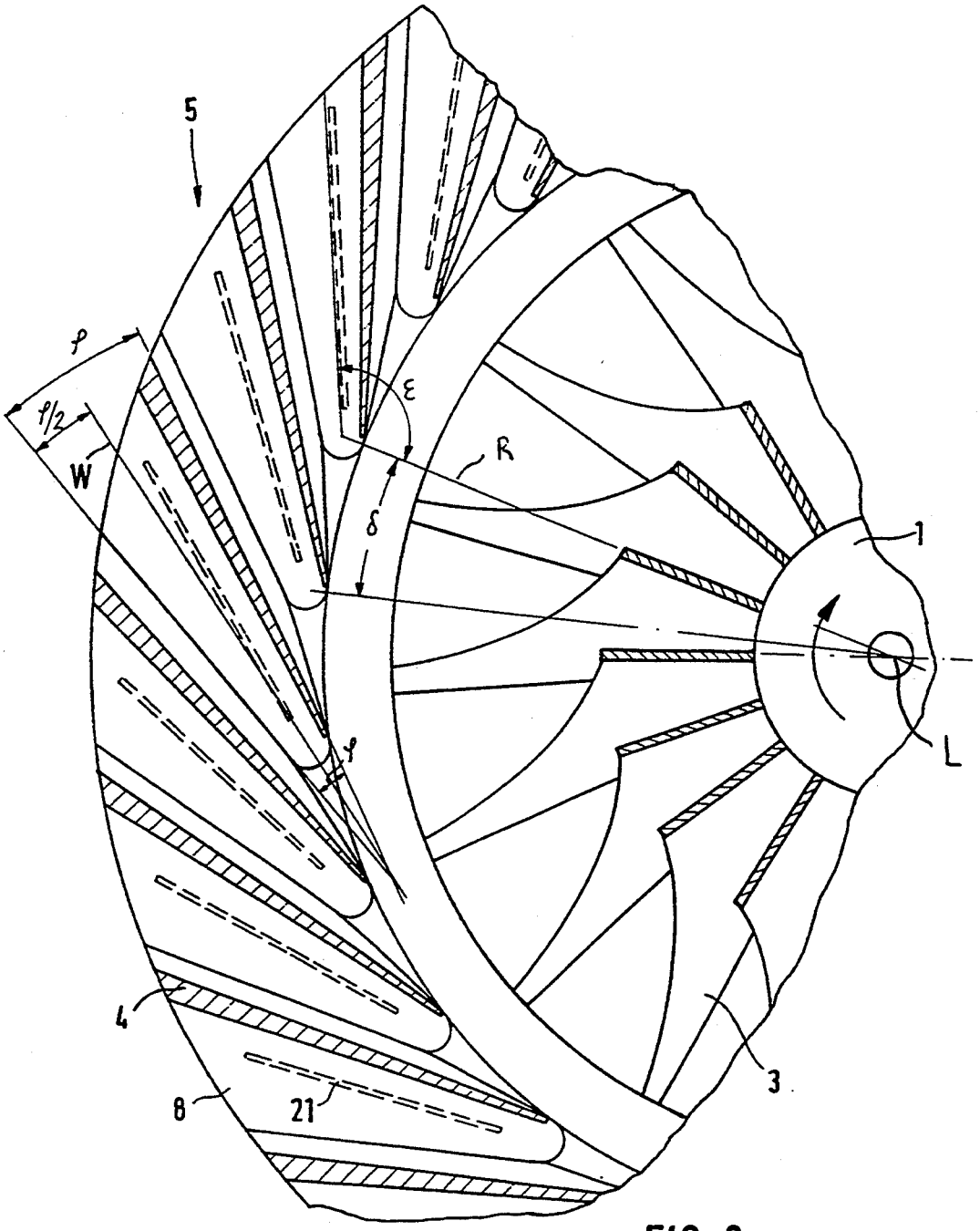
FIG. 2 is an axially normal partial sectional view of the radial-flow compressor with the radial-flow diffuser.
Figure 3:
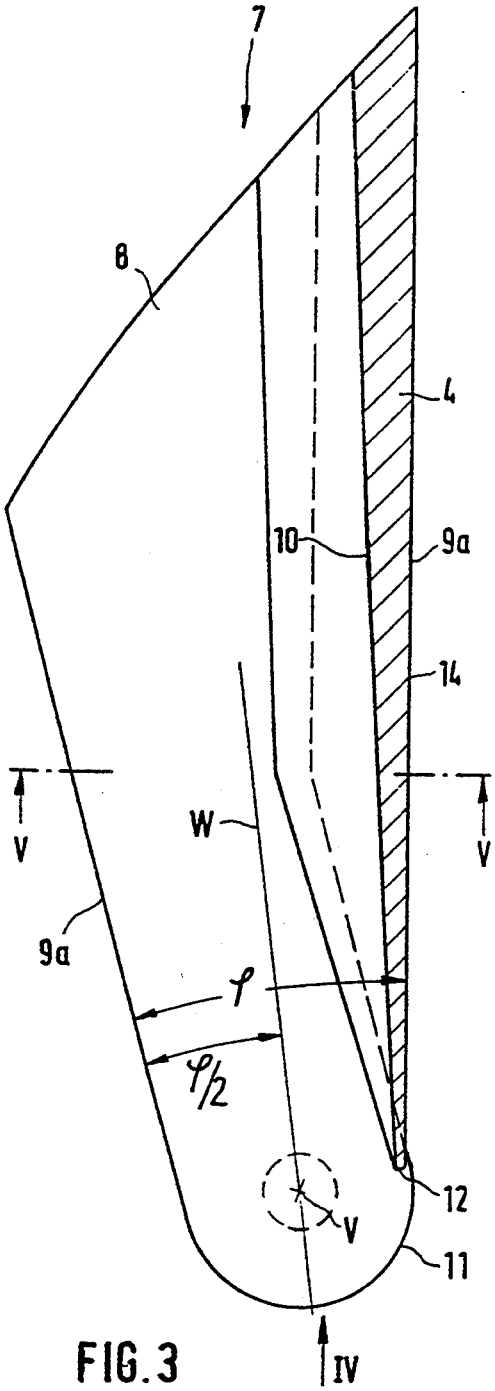
FIG. 3 is a cross-sectional view of an individual U-shaped adjusting element.
Figure 5:
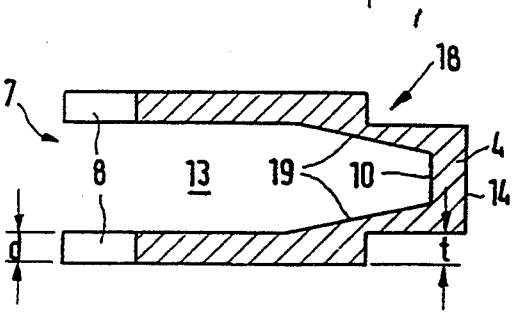
FIG. 5 is a horizontal sectional view of the adjusting element taken along line V—V of FIG. 3.
Figure 4:
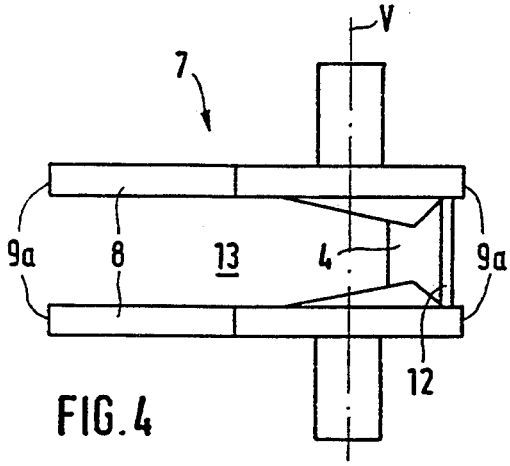
FIG. 4 is a view of the adjusting element on the leading edge of the blade taken along line IV—IV of FIG. 3.

The partial sectional view according to FIG. 2 illustrates that the radial-flow diffuser 5 comprises a plurality of adjusting elements 7 (see FIG. 3), each having a diffuser blade 4, which are distributed uniformly on the circumference. As illustrated in FIGS. 3, 4 and 5, an adjusting element 7 is in each case formed of two sector-shaped plates 8 with the sector angle $\phi$ and one diffuser blade 4. The plates 8 of an adjusting element, which are arranged in parallel to one another, enclose at their radial edge 9*a* diffuser blade 4 between one another and thus provide the adjusting element 7 with a U-shaped design.

Figure 6:
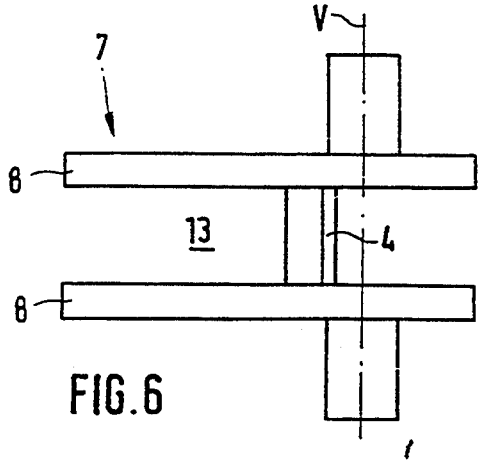
FIG. 6 is a view of an H-shaped adjusting element.

An alternative embodiment of an adjusting element 7 with an H-shaped design is illustrated in FIG. 6. In this case, the diffuser blade 4 extends between the two radial edges 9*a* of the plates 8.

As illustrated in FIG. 3, the placing of the diffuser blade 4 in the adjusting element 7 is selected in such a manner that the diffuser blade 4 extends by way of its blade depth along a radially extending edge 9*a*, and the delivery side 10 of the diffuser blade 4 points into the interior of the U-shaped adjusting element. The circle-segment-shaped plates 8 have a rounded edge 11 on their radially interior end, thus at their narrowest point, and therefore deviate from an exact sector of a circle. In the transition area between the end 11 and the edge 9*a*, the diffuser blade 4 ends with its leading edge 12. The center of the round end 11 is situated on the adjusting axis V of the adjusting element 7. The adjusting axis V is therefore disposed perpendicularly to the plane of the plates 8 of an adjusting element.

The adjusting axis V is situated perpendicularly with respect to the bisecting line W of the plates 8 of each adjusting element 7, as illustrated in FIGS. 2 and 3. The adjusting elements 7 are arranged obliquely in the diffuser annulus. In this case, the element angle $\epsilon$ measured between the bisecting line W and a radial R, which is situated perpendicularly on the longitudinal axis L of the compressor and the adjusting axis V, may amount to 90°-180°, but in this case amounts to approximately 120°. For the adjusting of the adjusting elements 7 in the same direction, the element angle $\epsilon$ of each adjusting element 7 can be varied by the same amount. The adjusting axes V of all adjusting elements 7 are arranged in parallel and at the same radial distance a to the longitudinal axis L of the compressor, as illustrated in FIGS. 1 and 2.

The adjusting elements which are uniformly spaced with respect to one another at the angular pitch $\delta$ in the circumferential direction of the radial-flow diffuser 5 are illustrated in FIG. 2.

On the one side, the diffuser ducts 13 (FIGS. 4–6) are bounded by the interior of the adjusting elements 7 and, on the other side, by the suction side 14 of the diffuser blade 4 of the adjacent adjusting element 7 in a variable manner. By means of the swivel movement S of the adjusting elements 7 in the same direction about their adjusting axis V, the radial-flow diffuser 5 can be throttled or unthrottled. A throttling is achieved by means of the swivel movement of the adjusting elements 7 to the diffuser interior I (FIG. 7*a*), and an unthrottling is achieved correspondingly by means of a swivel movement toward the diffuser exterior A. In the throttled condition, a minimal narrow cross-section $Q_{min}$ (see FIG. 7*a*) is therefore obtained of the diffuser ducts 13 between adjacent diffuser blades 4 in the area of the leading blade edge 12 and correspondingly in the unthrottled condition, a maximal narrow cross-section $Q_{max}$ (see FIG. 7*b*) is obtained.

Figure 7A:
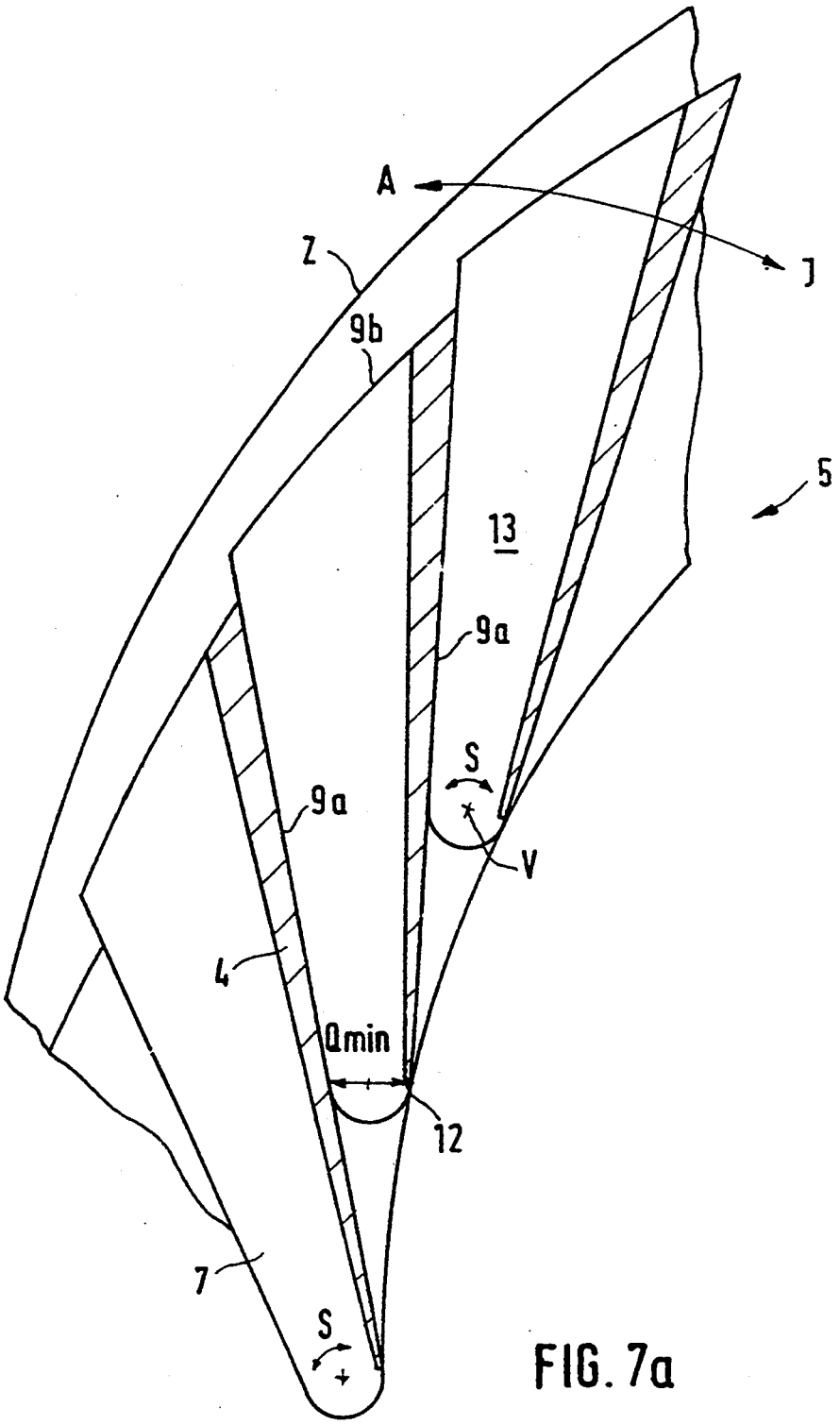
FIG. 7*a* is an axially normal partial sectional view of the radial-flow diffuser with the adjusting elements in the throttling position.
Figure 7B:
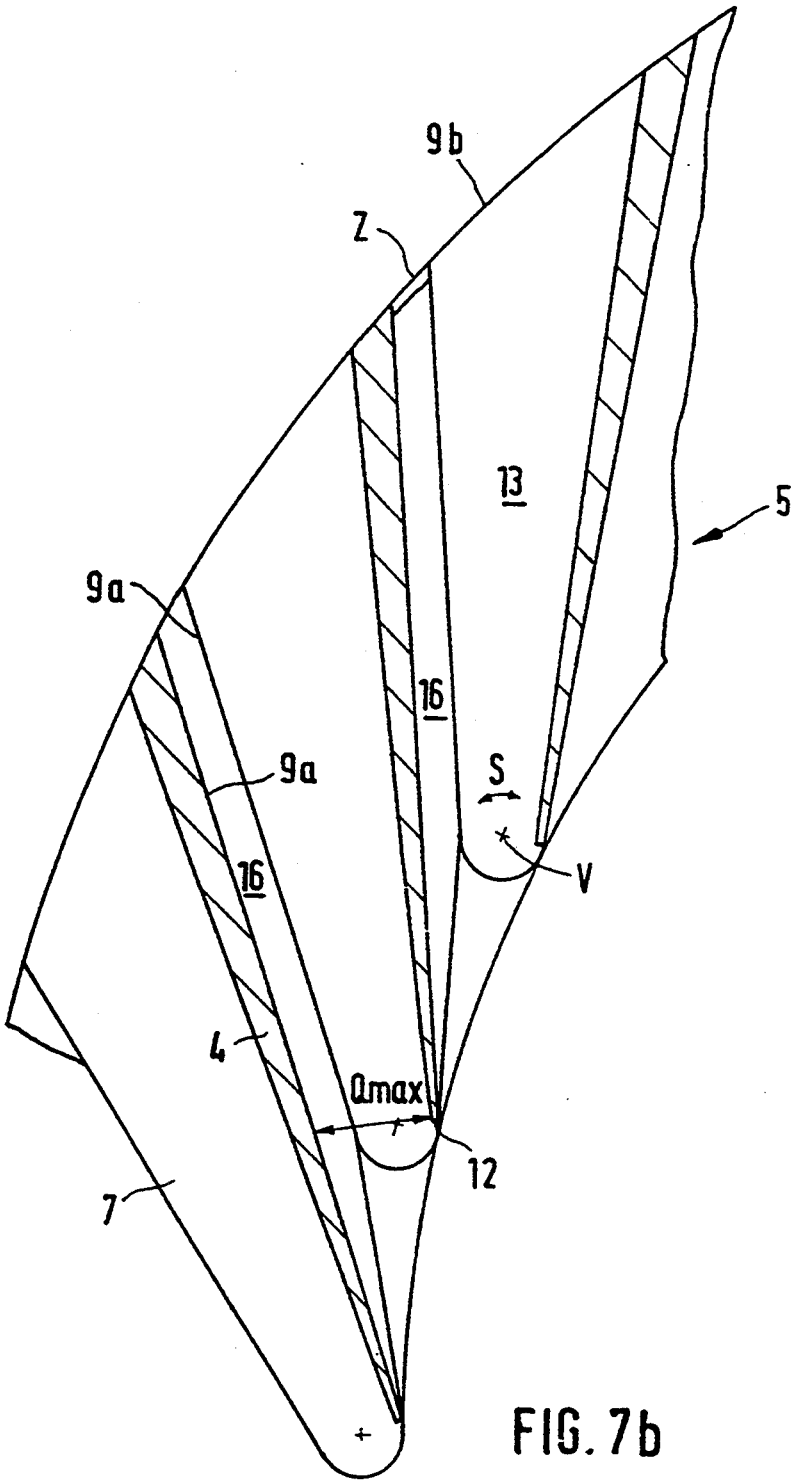
FIG. 7*b* is an axially normal partial sectional view of the radial-flow diffuser with the adjusting elements in the opened position.

As illustrated in FIG. 7*a*, the plates 8 of adjacent adjusting elements 7 adjoin along their edges 9*a* in a tight and continuous manner. In the case of the unthrottled position of the adjusting elements 7 shown in FIG. 7*b*, these are spaced at constant distances from one another along adjacent plates 8; that is, between the edges 9*a* of adjacent plates 8, a gap 16 is formed that is parallel along the length of the edge. At the same time, the curved, radially exterior edges 9*b* of the plates 8 come to rest on a cylinder surface Z which is concentric to the longitudinal axis L of the compressor, in which case this cylinder surface Z is part of the diffuser housing 16. The curved radius of the exterior edges therefore corresponds to the radius of this cylinder surface Z.

Figure 8A:
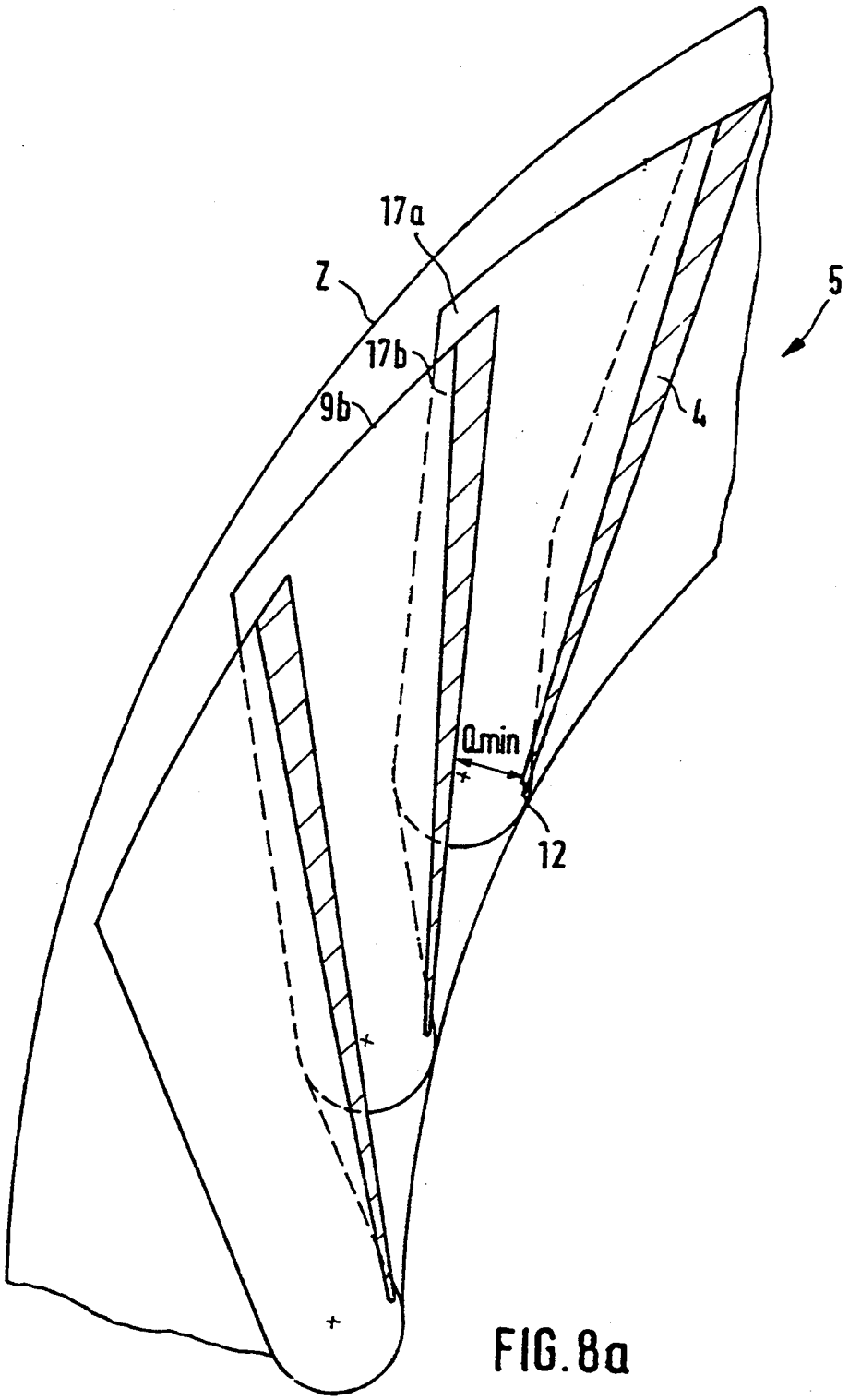
FIG. 8*a* is a partial sectional view as in the case of FIG. 7*a*, but with the adjusting elements in an interlaced construction.
Figure 8B:
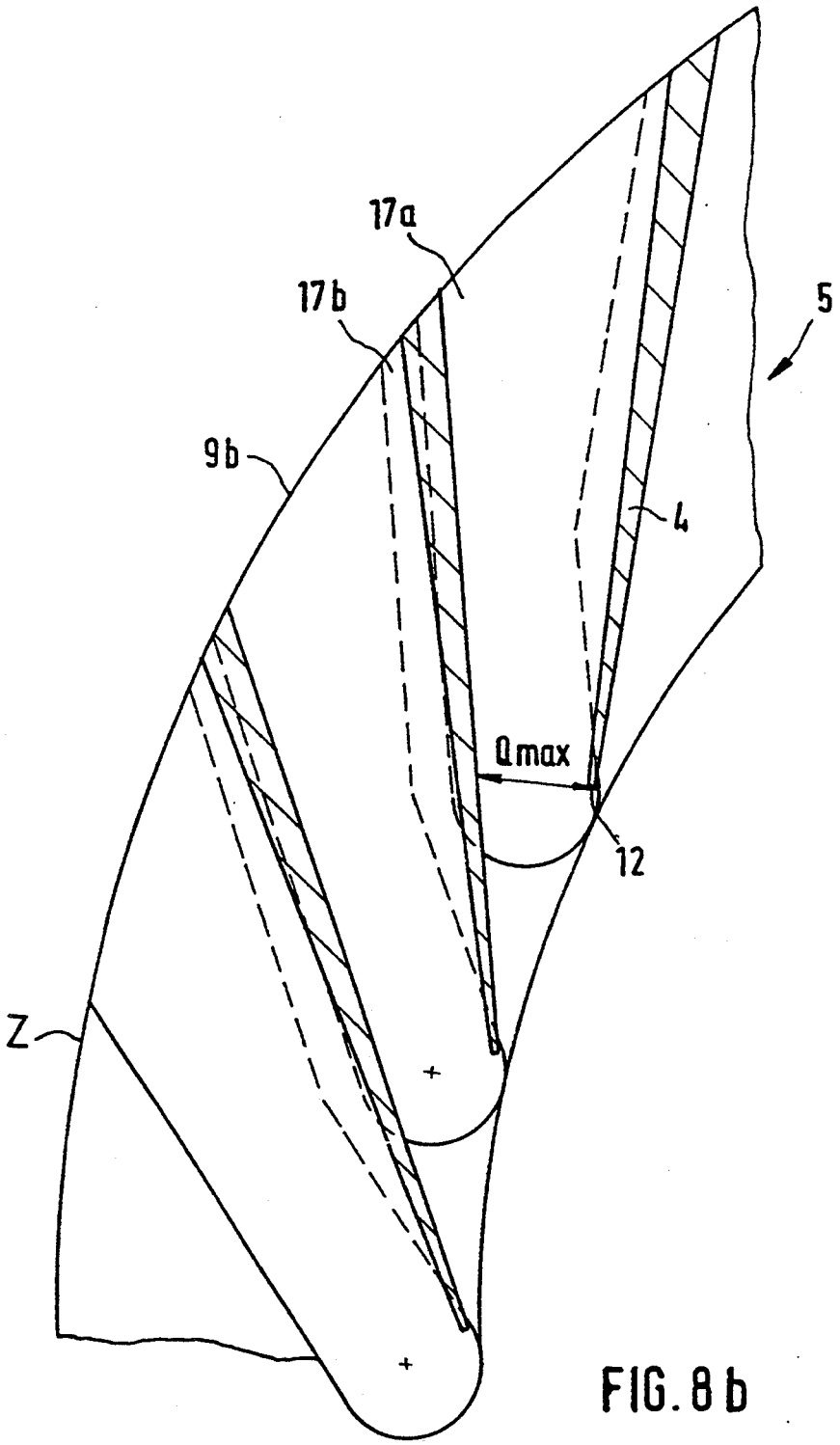
FIG. 8*b* is a partial sectional view as in the case of FIG. 7*b*, but with the adjusting elements in an interlaced construction.

As an alternative to the above-described adjusting elements 7, FIGS. 8*a* and 8*b* illustrate adjusting elements 7 in an overlapping engaging arrangement. The free plate ends 17*a*, which are situated opposite the diffuser blade 4, reach around the plate ends 17*b* of the adjacent adjusting element 7, which are provided with a diffuser blade 4, within their swivel area of the adjusting elements 7. As illustrated in FIGS. 3 and 5, for this purpose, the plate ends 17*b* each have a recess 18 extending in the plate plane, whose depth t transversely to the plane corresponds to the plate thickness d of the adjacent plate 8 for receiving the plate 8 or its free plate end 17*a*. Thus, the width of the recess 18 corresponds to the maximal overlapping width of the adjusting elements, as occurring in the case of the throttled position of the adjusting elements 7 (see FIG. 8*a*). In addition, the recess 18 extends in parallel to the edge 9*a* of the plate end 17*a* of the adjacent adjusting element 7. Furthermore, the adjusting elements 7 are each provided with slopes 19 in the diffuser ducts 13 between the diffuser blade 7 and the plates 8 for the compensation of the recesses 18. The slopes 19 therefore narrow the diffuser duct 13 in the direction of the diffuser blade 4.

Figure 9:
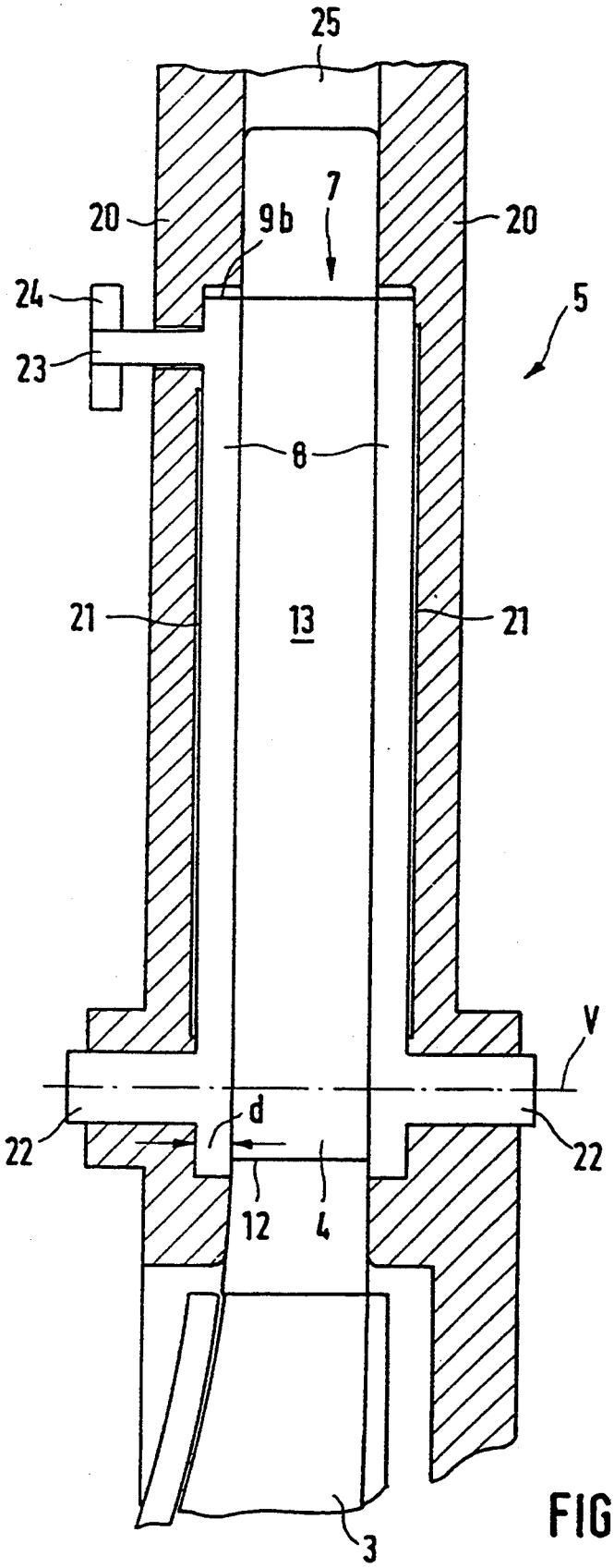
FIG. 9 is an enlargement of a cut-out of the axial sectional view of the radial-flow diffuser.

FIG. 9 illustrates the bearing of the adjusting elements 7 between two diffuser walls 20 of the diffuser housing 16 which extend perpendicularly with respect to the longitudinal axis L of the compressor. In each case, the nozzle walls 20 have a milled-out area which is concentric to the longitudinal axis L of the compressor and which receives the plates 8, in which case the inlet and outlet-side transitions of the plates 8 to the nozzle walls 20 are constructed largely without any steps. Between the nozzle walls 20 and the plates 8, one sealing device 21 respectively is arranged which extends in the radial direction and has the purpose of avoiding transverse flows.

For the bearing of the adjusting elements 7 in the nozzle walls 20, the plates 8 are provided, outside the diffuser duct 13, with bearing journals which are coaxial with respect to the adjusting axis V and which are received in bores of the nozzle walls 20. For an adjusting of the adjusting elements 7 in the same direction, one plate 8 respectively of an adjusting element has an adjusting pin 23 which is coupled with an adjusting device 24. The connecting of the nozzle walls 20 with one another takes place by way of webs 25.

What is claimed is:

1. An adjustable radial flow diffuser for a radial flow compressor, comprising:

adjusting elements having diffuser blades, said adjusting elements being arranged in a diffuser annulus uniformly distributed along the diffuser circumference with a constant angular pitch δ, said adjusting elements further being swivellable about an adjusting axis V parallel to the longitudinal axis of the compressor for changing the narrow cross-section between the adjacent diffuser blades, wherein said adjusting elements have one of a substantially U-shaped and H-shaped cross-section with sector-shaped plates that are mounted on both sides of a blade root to form the legs and the diffuser blade forming said one web of the cross-section.

2. A radial-flow diffuser according to claim 1, wherein the adjusting elements are swivellable synchronously and in the same direction via an adjusting arrangement.

3. A radial-flow diffuser according claim 1, wherein the adjusting axis V of a respective adjusting element extends perpendicularly on a bisecting line W of the adjusting element.

4. A radial-flow diffuser according to claim 1, wherein the plates, on a leading-edge side, are in each case rounded off with an end which is concentric with respect to the adjusting axis V.

5. A radial-flow diffuser according to claim 1, wherein the adjusting elements have bearing journals which are each coaxial to the adjusting axes V and which are disposed in the diffuser housing.

6. A radial-flow diffuser according to claim 1, wherein a sector angle $\phi$ of the adjusting elements which has a tendency to open radially toward the outside, corresponds to the angular pitch δ.

7. A radial-flow diffuser according to claim 1, wherein the diffuser blades with their chord length are adjusted in a substantially radial direction on the sector-shaped plates.

8. An adjustable radial flow diffuser for a radial flow compressor, comprising:

adjusting elements having diffuser blades, said adjusting elements being arranged in a diffuser annulus uniformly distributed along the diffuser circumference with an angular pitch δ, said adjusting elements further being swivellable about and adjusting axis V parallel to the longitudinal axis of the compressor for changing the narrow cross-section between the diffuser blades, wherein said adjusting elements have one of a substantially U-shaped and H-shaped cross-section with sector-shaped plates that are mounted on both sides of a blade root to form the legs and the diffuser blade forming the web of said one cross-section, wherein as an inlet-side lengthening of the plates, one wedge-shaped step respectively is arranged which has a circular recess which is concentric with respect to the adjusting axes V, and reaches around the end, and the height of the step is adapted to the plate thickness d for the formation of a continuous transition.

9. A radial-flow diffuser according to claim 8, wherein the adjusting elements have bearing journals which are each coaxial to the adjusting axes V and which are disposed in the diffuser housing.

10. A radial-flow diffuser for a radial flow compressor, comprising:

adjusting elements having diffuser blades, said adjusting elements being arranged in a diffuser annulus uniformly distributed along the diffuser circumference with an angular pitch δ, said adjusting elements further being swivellable about and adjusting axis V parallel to the longitudinal axis of the compressor for changing the narrow cross-section between the diffuser blades, wherein said adjusting elements have one of a substantially U-shaped and H-shaped cross-section with sector-shaped plates that are mounted on both sides of a blade root to form the legs and the diffuser blade forming the web cross-section, wherein the outlet-side edge of the adjusting elements has a circular-arc-shaped course, the edge, in the case of the angular position of the adjusting elements pertaining to the maximal narrow cross-section $Q_{max}$, resting on a cylinder surface Z which is concentric with respect to the longitudinal axis L of the compressor.

11. A radial-flow diffuser according to claim 10, wherein the case of the angular position pertaining to the narrow cross-section $Q_{min}$, adjacent adjusting elements adjoin on their radially extending plate edges.

12. An adjustable radial flow diffuser for a radial flow compressor, comprising:

adjusting elements having diffuser blades, said adjusting elements being arranged in a diffuser annulus uniformly distributed along the diffuser circumference with an angular pitch δ, said adjusting elements further being swivellable about and adjusting axis V parallel to the longitudinal axis of the compressor for changing the narrow cross-section between the diffuser blades, wherein said adjusting elements have one of a substantially U-shaped and H-shaped cross-section with sector-shaped plates that are mounted on both sides of a blade root to form the legs and the diffuser blade forming the web of said one cross-section, wherein adjacent adjusting elements engage in one another in an overlapping manner at least on a portion of their swivel range.

13. A radial-flow diffuser according to claim 12, wherein the plates of the U-shaped adjusting elements have, outside the diffuser ducts along their blade-side plate ends, one recess respectively which extends in the plane of the plate and whose dimensions are coordinated for receiving the adjacent plate, and the adjusting elements are interlaced with one another via the mutual engaging of their plate ends in recesses of adjacent adjusting elements.

14. A radial-flow diffuser according to claim 13, wherein the plates extend in the area of the recess in a manner that is sloped in the direction of the diffuser blade, which narrows the diffuser duct.

* * * * *